US010767501B2

(12) United States Patent
Weber et al.

(10) Patent No.: US 10,767,501 B2
(45) Date of Patent: Sep. 8, 2020

(54) ARTICLE, COMPONENT, AND METHOD OF MAKING A COMPONENT

(71) Applicant: GENERAL ELECTRIC COMPANY, Schenectady, NY (US)

(72) Inventors: Joseph Anthony Weber, Simpsonville, SC (US); Srikanth Chandrudu Kottilingam, Greenville, SC (US); Brian Lee Tollison, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 627 days.

(21) Appl. No.: 15/134,758

(22) Filed: Apr. 21, 2016

(65) Prior Publication Data

US 2017/0306774 A1 Oct. 26, 2017

(51) Int. Cl.

| | |
|---|---|
| ***F01D 5/04*** | (2006.01) |
| ***F01D 9/02*** | (2006.01) |
| ***F01D 25/00*** | (2006.01) |

(52) U.S. Cl.

CPC ..... *F01D 9/02* (2013.01); *F01D 5/041* (2013.01); *F01D 25/005* (2013.01);
(Continued)

(58) Field of Classification Search

CPC .. F01D 9/02; F05D 2220/32; F05D 2230/237; F05D 2230/80; F05D 2230/90;
(Continued)

(56) References Cited

U.S. PATENT DOCUMENTS 4,305,697 A 12/1981 Cohen et al.
6,413,040 B1 * 7/2002 Yu ..... F01D 9/065 415/115

(Continued)

FOREIGN PATENT DOCUMENTS

EP 1977852 A1 10/2008
EP 2412930 A2 2/2012

(Continued)

OTHER PUBLICATIONS

"Richardson, Mike, In good repair, Jul. 11, 2014, Aerospace Manufacturing" (Year: 2014).*

(Continued)

*Primary Examiner* — Aaron R Eastman
*Assistant Examiner* — Theodore C Ribadeneyra
(74) *Attorney, Agent, or Firm* — McNees Wallace & Nurick LLC

(57) ABSTRACT

An article, a component, and a method of making a component are provided. The article includes a contoured proximal face and a contoured distal face. The contoured proximal face is arranged and disposed to substantially mirror a contour of an end wall of a component. The component includes a first end wall, a second end wall, and an article including a contoured proximal face secured to at least one of the first end wall and the second end wall. The method of making a component includes forming an article having a proximal face and a distal face, contouring the proximal face of the article to form a contoured proximal face that substantially mirrors a contour of a first end wall or a second end wall of the component, and securing the contoured proximal face of the article to one of the first end wall and the second end wall.

16 Claims, 6 Drawing Sheets

(52) U.S. Cl.
CPC ..... *F05D 2220/32* (2013.01); *F05D 2230/22* (2013.01); *F05D 2230/237* (2013.01); *F05D 2230/80* (2013.01); *F05D 2230/90* (2013.01); *F05D 2240/12* (2013.01); *F05D 2240/128* (2013.01); *F05D 2240/15* (2013.01); *F05D 2240/80* (2013.01)

(58) Field of Classification Search
CPC ..... F05D 2240/12; F05D 2240/128; F05D 2240/15; F05D 2240/80
See application file for complete search history.

(56) References Cited

U.S. PATENT DOCUMENTS 8,714,909 B2 5/2014 Propheter-Hinckley
8,721,285 B2 5/2014 Liang
9,567,664 B2 * 2/2017 Bolz ..... C23C 14/083
2006/0289496 A1 * 12/2006 Kelly ..... B22F 7/06 219/679
2008/0075619 A1 * 3/2008 Hosamani ..... B22F 3/10 419/36
2009/0016881 A1 * 1/2009 Baldauf ..... F01D 5/22 416/95
2009/0064500 A1 3/2009 Reynolds et al.
2009/0074570 A1 * 3/2009 Milleville ..... C23C 30/00 415/200
2010/0028131 A1 * 2/2010 Arrell ..... F01D 5/3061 415/115
2011/0052931 A1 * 3/2011 Morton ..... C23C 30/005 428/552
2012/0027617 A1 2/2012 Garza et al.
2013/0004331 A1 * 1/2013 Beeck ..... F01D 5/143 416/97 R
2013/0089429 A1 * 4/2013 Nunez ..... C04B 35/571 416/230
2014/0237784 A1 8/2014 Lacy et al.
2014/0314556 A1 * 10/2014 Fremont ..... F01D 5/284 415/200
2015/0064018 A1 * 3/2015 Ahmad ..... F01D 5/147 416/90 R
2015/0251248 A1 * 9/2015 Becker ..... H01F 1/0577 419/26
2015/0315693 A1 * 11/2015 Seals ..... B23K 35/325 427/446
2015/0375322 A1 12/2015 Salm et al.
2016/0016230 A1 * 1/2016 Campomanes ..... C04B 35/638 264/118
2016/0059437 A1 * 3/2016 Lacy ..... B28B 1/001 165/168
2016/0067836 A1 3/2016 Huxol et al.
2017/0197282 A1 7/2017 Seemann et al.

FOREIGN PATENT DOCUMENTS

EP 2949418 A1 12/2015
GB 2071777 A 9/1981
WO WO 2016087215 A1 * 6/2016 ..... F01D 9/041

OTHER PUBLICATIONS

European Search Report for EP17166868.4, dated Sep. 22, 2017, 8 pages.

* cited by examiner

ARTICLE, COMPONENT, AND METHOD OF MAKING A COMPONENT

FIELD OF THE INVENTION

The present embodiments are directed to an article, a component, and a method of making a component. More specifically, the present embodiments are directed to a contoured article, a component including a contoured article, and a method of making a component including a contoured article.

BACKGROUND OF THE INVENTION

Hot gas path components within gas turbine engines are continuously exposed to elevated temperatures during normal operation. As gas turbines are modified to increase efficiency and decrease cost, the temperatures within the hot gas path are being increased while the geometries of the components are becoming more complex. In order to continue increasing the temperatures within the hot gas path, the turbine components in this area must be constructed of materials which can withstand such temperatures.

Typically, manufacturing and servicing of hot gas path components, such as nozzles, includes applying a material over a portion of the component. For example, servicing of hot gas path nozzles often includes brazing a sheet of material to an end wall of the nozzle. The end wall of the nozzle is usually contoured to provide a desired air flow thereover, while the sheets of material that are applied to the contoured end wall are generally flat. To maintain the contour of the end wall, the flat sheets are conformed to the contoured end wall during brazing.

However, the conforming of the flat sheet to the contoured end wall forms gaps in the bond interface between the material and the end wall. The gaps are often filled with air, which decreases heat transfer between the material and the end wall. The decrease in cooling effectiveness decreases efficiency of the turbine system and/or increases operating cost.

SUMMARY OF THE INVENTION

In an embodiment, an article includes a contoured proximal face and a contoured distal face. The contoured proximal face is arranged and disposed to substantially mirror a contour of at least one of an end wall and an airfoil outer surface of a component.

In another embodiment, a component includes a first end wall, a second end wall, an airfoil with an airfoil outer surface positioned between the first end wall and the second end wall, and an article secured to at least one of the first end wall, the second end wall, and the airfoil outer surface. The article includes a contoured proximal face and a contoured distal face. The contoured proximal face substantially mirrors a contour of at least one of the first end wall, the second end wall, and the airfoil outer surface.

In another embodiment, a method of making a component includes forming an article having a proximal face and a distal face, contouring the proximal face of the article to form a contoured proximal face, and securing the contoured proximal face of the article to at least one of a first end wall, a second end wall, and the airfoil portion of the component. Prior to the step of securing, the contoured proximal face substantially mirrors a contour of at least one of the first end wall, the second end wall, and the airfoil portion of the component.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are an article, a component, and a method of making a component. Embodiments of the present disclosure, for example, in comparison to concepts failing to include one or more of the features disclosed herein, decrease or eliminate the formation of gaps within a component, increase cooling effectiveness of a component, provide a closer tolerance between components and braze sheets, increase joint quality between braze sheets and components, increase component life, increase manufacturing efficiency, increase manufacturing yield, facilitate use of increased system temperatures, increase system efficiency, or a combination thereof.

Figure 2:
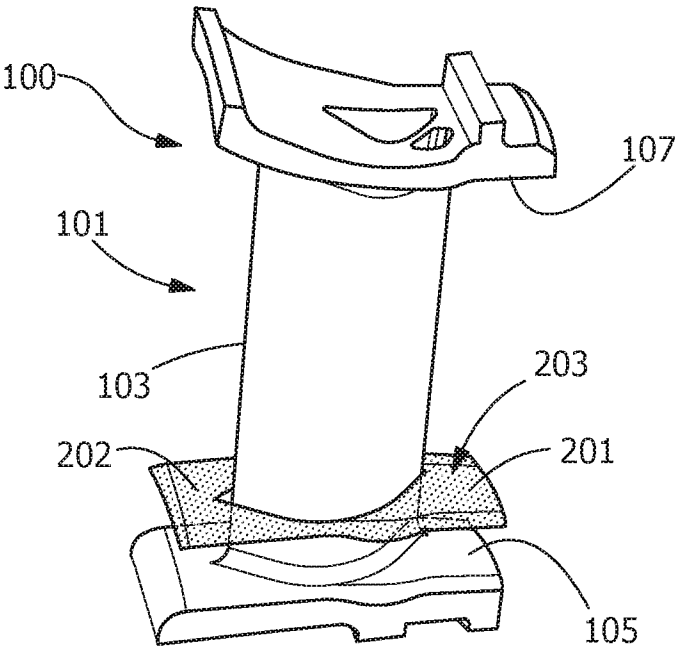
FIG. 2 is a perspective view of the component of FIG. 1 and an article to be secured to the lower end wall of the component, according to an embodiment of the disclosure.
Figure 1:
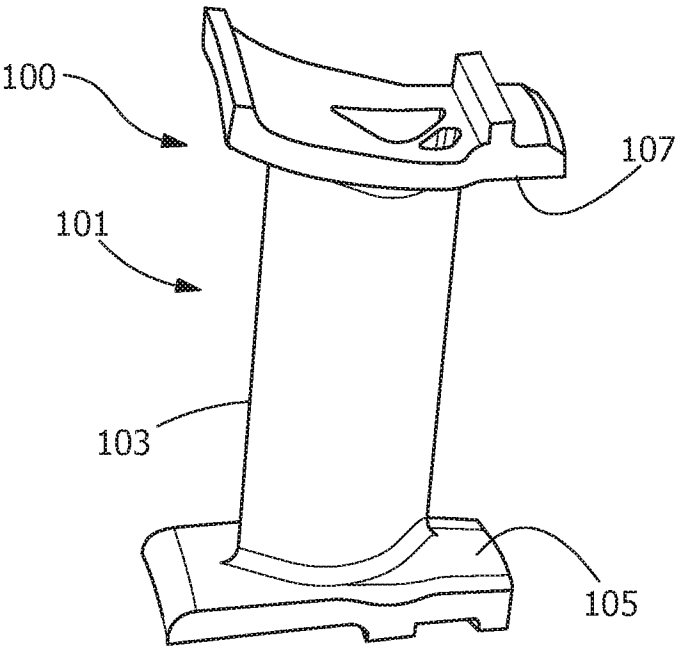
FIG. 1 is perspective view of a component, according to an embodiment of the disclosure.
Figure 3:
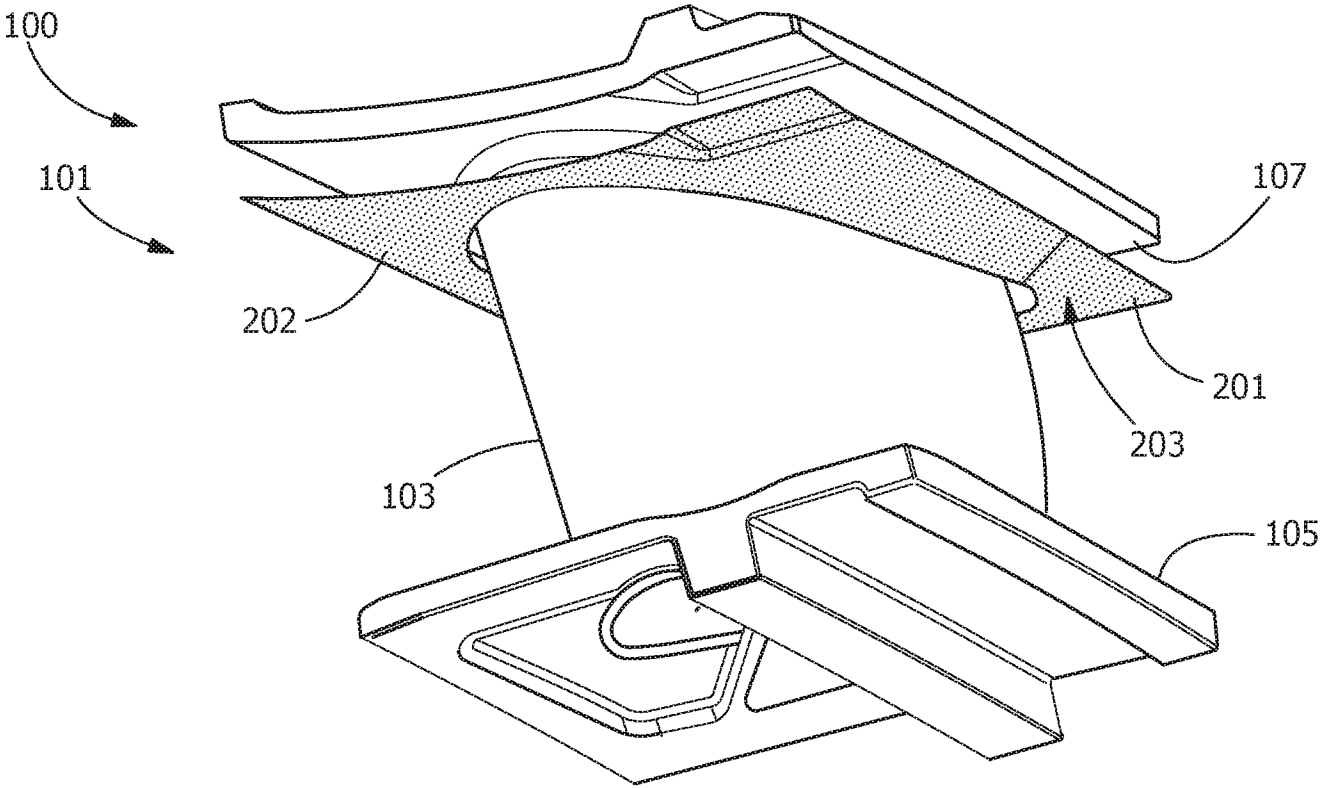
FIG. 3 is a perspective view of the component of FIG. 1 and an article to be secured to the upper end wall of the component, according to an embodiment of the disclosure.
Figure 4:
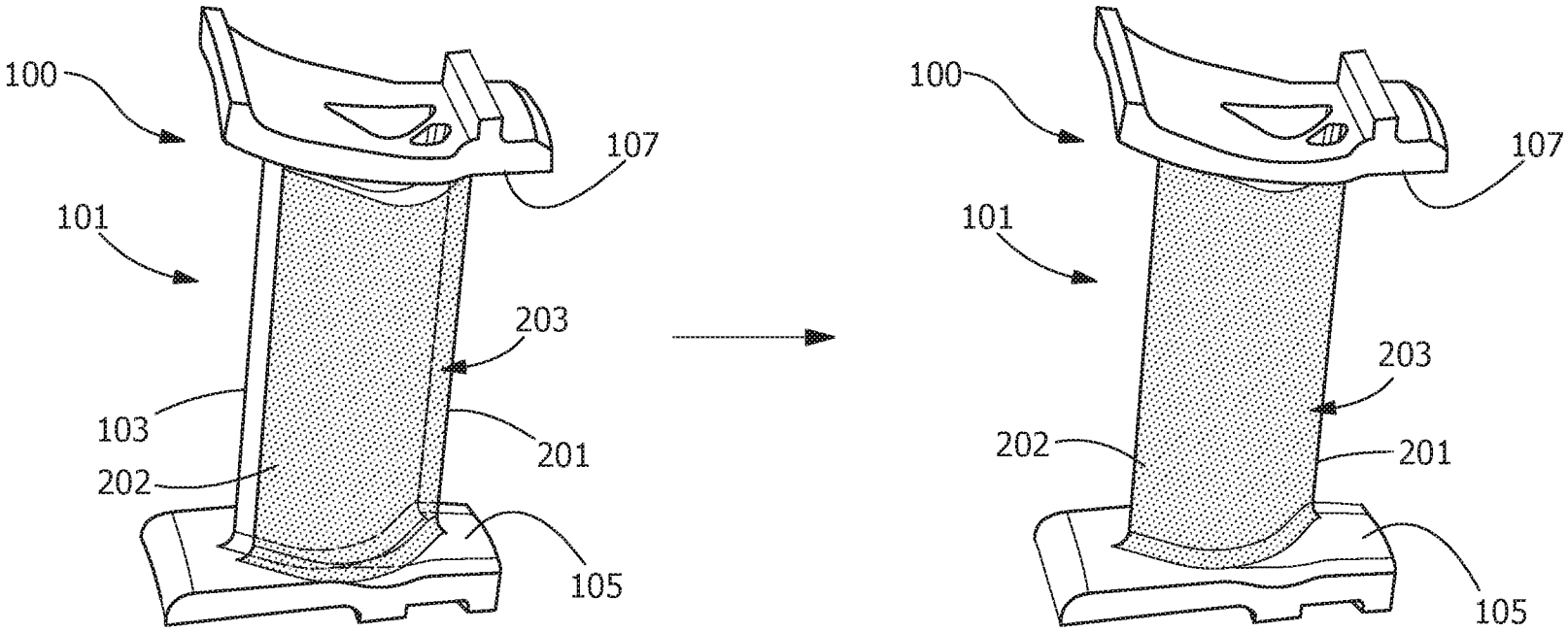
FIG. 4 is a perspective view of the component of FIG. 1 and an article being secured to the airfoil surface of the component by a method of forming the component, according to an embodiment of the disclosure.

Referring to FIG. 1, a component 100 includes any combustion and/or turbine component having surfaces that are exposed to elevated temperatures, such as, but not limited to, a shroud, a blade, a bucket, any other hot gas path component, or a combination thereof. For example, in one embodiment, the component 100 includes a nozzle 101 configured for use in a hot gas path of a turbine engine. In another embodiment, the nozzle 101 includes an airfoil portion 103 positioned between a first end wall 105 and a second end wall 107. In a further embodiment, as illustrated in FIGS. 2-4, the component 100 includes at least one article 201 secured to the first end wall 105 (FIG. 2) and/or the second end wall 107 (FIG. 3) and/or the airfoil portion 103 (FIG. 4) thereof. Although shown in FIGS. 2-4 as being secured to the first end wall 105, the second end wall 107, or the airfoil portion 103, as will be appreciated by those skilled in the art, the disclosure is not so limited and may include at least one of the articles 201 secured to any one, two, or all three of the first end wall 105, the second end wall 107, and the airfoil portion 103.

According to one or more of the embodiments disclosed herein, the article 201 may be secured to the first end wall 105 and/or the second end wall 107 and/or the airfoil portion 103 through any suitable method, such as, but not limited to, brazing, sintering, welding, or a combination thereof. The component 100 includes any suitable material having any suitable microstructure for continuous use in a turbine engine and/or within the hot gas path of the turbine engine. Suitable microstructures include, but are not limited to, equiaxed, directionally solidified (DS), single crystal (SX), or a combination thereof. Suitable materials of the component 100 include, but are not limited to, a metal, a ceramic, an alloy, a superalloy, steel, a stainless steel, a tool steel, nickel, cobalt, chrome, titanium, aluminum, or a combination thereof.

For example, in one embodiment, the material of the component 100 is a cobalt-based material including, but not limited to, a composition, by weight, of about 29% chromium (Cr), about 10% nickel (Ni), about 7% tungsten (W), about 1% iron (Fe), about 0.25% carbon (C), about 0.01% boron (B), and a balance of cobalt (Co) (e.g., FSX414); about 20% to about 24% Cr, about 20% to about 24% Ni, about 13% to about 15% W, about 3% Fe, about 1.25% manganese (Mn), about 0.2% to about 0.5% silicon (Si), about 0.015% B, about 0.05% to about 0.15% C, about 0.02% to about 0.12% lanthanum (La), and a balance of Co (e.g., HAYNES® 188); about 22.5% to about 24.25% Cr, about 9% to about 11% Ni, about 6.5% to about 7.5% W, about 3% to about 4% tantalum (Ta), up to about 0.3% titanium (Ti) (e.g., about 0.15% to about 0.3% Ti), up to about 0.65% C (e.g., about 0.55% to about 0.65% C), up to about 0.55% zirconium (Zr) (e.g., about 0.45% to about 0.55% Zr), and a balance of Co (e.g., Mar-M-509); or about 20% Ni, about 20% Cr, about 7.5% Ta, about 0.1% Zr, about 0.05% C, and a balance of Co (e.g., Mar-M-918).

In another embodiment, the material of the component 100 is a nickel-based material including, but not limited to, a composition, by weight, of about 9.75% Cr, about 7.5% Co, about 6.0% W, about 4.2% aluminum (Al), about 3.5% Ti, about 1.5% molybdenum (Mo), about 4.8% Ta, about 0.5% niobium (Nb), about 0.15% hafnium (Hf), about 0.05% C, about 0.004% B, and a balance of Ni (e.g., René N4); about 7.5% Co, about 7.0% Cr, about 6.5% Ta, about 6.2% Al, about 5.0% W, about 3.0% rhenium (Re), about 1.5% Mo, about 0.15% Hf, about 0.05% C, about 0.004% B, about 0.01% yttrium (Y), and a balance of Ni (e.g., René N5); refers to an alloy including a composition, by weight, of about 7.5% Co, about 13% Cr, about 6.6% Al, about 5% Ta, about 3.8% W, about 1.6% Re, about 0.15% Hf, and a balance of Ni (e.g., René N2); between about 9% and about 10% Co, between about 9.3% and about 9.7% W, between about 8.0% and about 8.7% Cr, between about 5.25% and about 5.75% Al, between about 2.8% and about 3.3% Ta, between about 1.3% and about 1.7% Hf, up to about 0.9% Ti (for example, between about 0.6% and about 0.9%), up to about 0.6% Mo (for example, between about 0.4% and about 0.6%), up to about 0.2% Fe, up to about 0.12% Si, up to about 0.1% Mn, up to about 0.1% copper (Cu), up to about 0.1% C (for example, between about 0.07% and about 0.1%), up to about 0.1% Nb, up to about 0.02% Zr (for example, between about 0.005% and about 0.02%), up to about 0.02% B (for example, between about 0.01% and about 0.02%), up to about 0.01% phosphorus (P), up to about 0.004% sulfur (S), and a balance of Ni (e.g., René 108); about 13.70% to about 14.30% Cr, about 9.0% to about 10.0% Co, about 4.7% to about 5.1% Ti, about 3.5% to about 4.1% W, about 2.8% to about 3.2% Al, about 2.4% to about 3.1% Ta, about 1.4% to about 1.7% Mo, 0.35% Fe, 0.3% Si, about 0.15% Nb, about 0.08% to about 0.12% C, about 0.1% Mn, about 0.1% Cu, about 0.04% Zr, about 0.005% to about 0.020% B, about 0.015% P, about 0.005% S, and a balance of Ni (e.g., GTD-111®, available from General Electric Company); about 22.2% to about 22.8% Cr, about 18.5% to about 19.5% Co, about 2.3% Ti, about 1.8% to about 2.2% W, about 1.2% Al, about 1.0% Ta, about 0.8% Nb, about 0.25% Si, about 0.08% to about 0.12% C, about 0.10% Mn, about 0.05% Zr, about 0.008% B, and a balance of Ni (e.g., GTD-222®, available from General Electric Company); about 9.75% Cr, about 7.5% Co, about 6.0% W, about 4.2% Al, about 4.8% Ta, about 3.5% Ti, about 1.5% Mo, about 0.08% C, about 0.009% Zr, about 0.009% B, and a balance of Ni (e.g., GTD-444®, available from General Electric Company); about 15.70% to about 16.30% Cr, about 8.00% to about 9.00% Co, about 3.20% to about 3.70% Ti, about 3.20% to about 3.70% Al, about 2.40% to about 2.80% W, about 1.50% to about 2.00% Ta, about 1.50% to about 2.00% Mo, about 0.60% to about 1.10% Nb, up to about 0.50% Fe, up to about 0.30% Si, up to about 0.20% Mn, about 0.15% to about 0.20% C, about 0.05% to about 0.15% Zr, up to about 0.015% S, about 0.005% to about 0.015% B, and a balance of Ni (e.g., INCONEL® 738); or about 9.3% to about 9.7% W, about 9.0% to about 9.5% Co, about 8.0% to about 8.5% Cr, about 5.4% to about 5.7% Al, up to about 0.25% Si, up to about 0.1% Mn, about 0.06% to about 0.09% C, incidental impurities, and a balance of Ni (e.g., Mar-M-247).

In a further embodiment, the material of the component 100 is an iron-based material including, but not limited to, a composition, by weight, of about 50% to about 55% Ni and Co combined, about 17% to about 21% Cr, about 4.75% to about 5.50% Nb and Ta combined, about 0.08% C, about 0.35% Mn, about 0.35% Si, about 0.015% P, about 0.015% S, about 1.0% Co, about 0.35% to 0.80% Al, about 2.80% to about 3.30% Mo, about 0.65% to about 1.15% Ti, about 0.001% to about 0.006% B, about 0.15% Cu, and a balance of Fe (e.g., INCONEL® 718). Other materials of the component 100 include, but are not limited to, a CoCrMo alloy, such as, for example, 70Co-27Cr-3Mo; a ceramic matrix composite (CMC); or a combination thereof.

"INCONEL" is a federally registered trademark of alloys produced by Huntington Alloys Corporation, Huntington, W. Va. "HAYNES" is a federally registered trademark of alloys produced by Haynes International, Inc., Kokomo, Ind.

The article 201 includes any material suitable for being secured directly or indirectly to the first end wall 105 and/or the second end wall 107, and/or for continuous use in a turbine engine and/or within the hot gas path of the turbine engine. In some embodiments, the article 201 is a single piece. In other embodiments, the article 201 is provided as multiple pieces. The number of pieces in which the article 201 is provided may depend on how much surface area coverage is required for the component 100 and the complexity of the flow path surface contours on the article 201 or on the component 100.

The material of the article 201 may be the same, substantially the same, or different from the material of the component 100. In one embodiment, the material of the article 201 includes a pre-sintered preform (PSP). In another embodiment, the PSP contains at least two materials with various mixing percentages. A first material includes, for example, any of the materials suitable for the hot-gas path of a turbine system disclosed herein. A second material includes, for example, a braze alloy, such as, but not limited to, a nickel braze alloy material having a composition, by weight, of between about 13% and about 15% Cr, between about 9% and about 11% Co, between about 2.25% and about 2.75% Ta, between about 3.25% and about 3.75% Al, between about 2.5% and about 3% B, up to about 0.1% Y (for example, between about 0.02% and about 0.1% Y), and a balance of Ni; or between about 18.5% and about 19.5% Cr, between about 9.5% and about 10.5% Si, about 0.1% Co, about 0.03% B, about 0.06% C, and a balance of Ni.

In some embodiments, the first material is a high melt powder and the second material is a low melt powder. The material of the article 201 is therefore a mixture of a high melt powder and a low melt powder sintered to make the article 201 rigid. The ratio of high melt powder to low melt powder is preferably in the range of 70:30 to 35:65, alternatively in the range of 60:40 to 45:55, alternatively 60:40, or ranges or sub-ranges therebetween.

In some embodiments, the high melt powder is a composition, by weight, including, but not limited to, about 9.3% to about 9.7% W, about 9.0% to about 9.5% Co, about 8.0% to about 8.5% Cr, about 5.4% to about 5.7% Al, up to about 0.25% Si, up to about 0.1% Mn, about 0.06% to about 0.09% C, incidental impurities, and a balance of Ni (e.g., Mar-M-247); about 6.8% Cr, about 12% Co, about 6.1% Al, about 4.9% W, about 1.5% Mo, about 2.8% Re, about 6.4% Ta, about 1.5% Hf, and a balance of Ni (e.g., René 142); about 7.6% Cr, about 3.1% Co, about 7.8% Al, about 5.5% Ta, about 0.1% Mo, about 3.9% W, about 1.7% Re, about 0.15% Hf, and a balance of Ni (e.g., René 195); or about 7.5% Co, about 13% Cr, about 6.6% Al, about 5% Ta, about 3.8% W, about 1.6% Re, about 0.15% Hf, and a balance of Ni (e.g., René N2).

In some embodiments, the low melt powder is a composition, by weight, including, but not limited to, about 71% Ni, about 19% Cr, and about 10% Si (e.g., AMS4782); about 14.0% Cr, about 10.0% Co, about 3.5% Al, about 2.7% B, about 0.02% Y, and a balance of Ni (e.g., DF4B); between about 13% and about 15% Cr, between about 9% and about 11% Co, between about 3.2% and about 3.8% Al, between about 2.2% and about 2.8% Ta, between about 2.5% and about 3.0% B, up to about 0.10% Y (optionally present), and a balance of Ni; between about 14% and about 16% Co, between about 19% and about 21% Cr, between about 4.6% and about 5.4% Al, a maximum of about 0.02% B, a maximum of about 0.05% C, between about 7.5% and about 8.1% Si, a maximum of about 0.05% Fe, and a balance of Ni; or about 15.3% Cr, about 10.3% Co, about 3.5% Ta, about 3.5% Al, about 2.3% B, and a balance of Ni.

In some embodiments, material of the article 201 is a high melt powder of Mar-M-247, a low melt powder of AMS4782 and the ratio of high melt powder to low melt powder is 60:40.

Multiple powders may be mixed to get the predetermined desired properties and braze temperature. The PSP pieces may be held in place on one or more of the nozzle surfaces by tack welding to enable positioning and retention of the article 201 during a brazing cycle. More specifically, the tack welding may involve resistance welding or fusion welding. In some embodiments, the brazing is vacuum brazing.

In some embodiments, after the article 201 is secured to the component 100, a bond coat followed by a thermal barrier coating are applied to the article 201 and/or the component 100.

In one embodiment, the article 201 includes a contoured proximal face 202 and a contoured distal face 203. The contoured proximal face 202 and/or the contoured distal face 203 are formed through any suitable method, such as, but not limited to, contouring of the article 201 during manufacturing, contouring of the article 201 after manufacturing, bending of the article 201, machining of the article 201, or a combination thereof. The contoured proximal face 202 and the contoured distal face 203 may also be formed simultaneously or separately, and include the same, substantially the same, or different shapes and/or contours.

Figure 5:
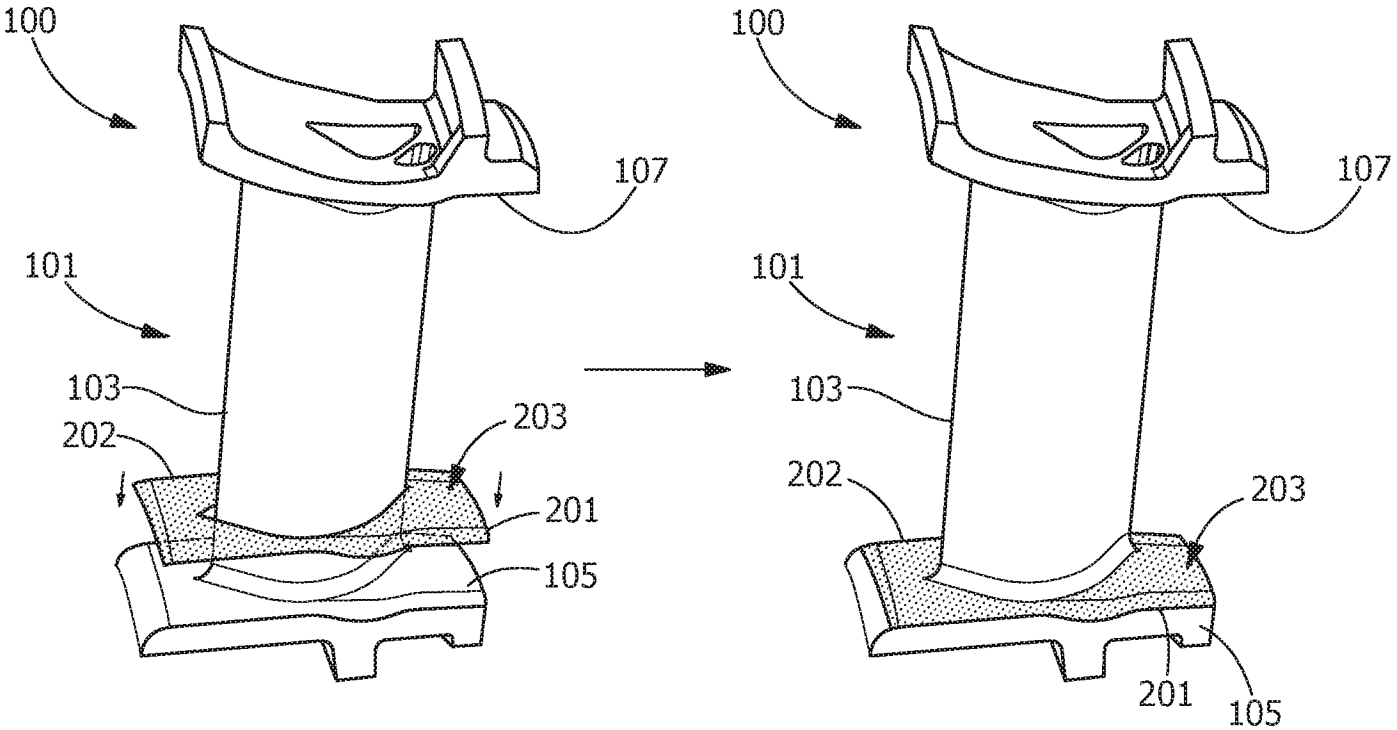
FIG. 5 is a process view of a method of forming a component, according to an embodiment of the disclosure.

Referring to FIGS. 4, 5, 6, and 8, the contoured proximal face 202 is arranged and disposed for securing the article 201 directly or indirectly to the first end wall 105 and/or the second end wall 107 and/or the airfoil portion 103 of the component 100. For example, in one embodiment, as illustrated in FIGS. 4-5, the contoured proximal face 202 is secured directly to the first end wall 105 and/or the second end wall 107 and/or the airfoil portion 103, and includes a shape and/or contour that, prior to securing the article 201 to the first end wall 105 and/or the second end wall 107 and/or the airfoil portion 103, mirrors or substantially mirrors the shape and/or contour of the first end wall 105 and/or the second end wall 107 and/or the airfoil portion 103. By "mirrors" or "substantially mirrors" it is meant that the contoured proximal face 202 of the article 201 has a geometry that follows a geometry of the first end wall 105 and/or the second end wall 107 and/or the airfoil portion 103, providing direct contact between the surfaces thereof.

Figure 7:
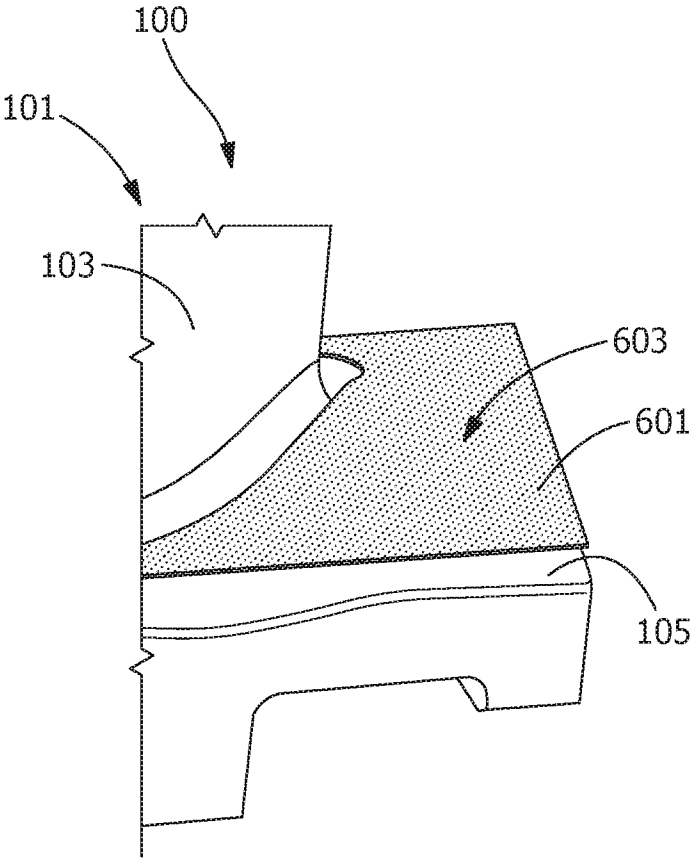
FIG. 7 (Prior Art)
FIG. 7 is an enlarged view of a prior art article positioned over an end wall of a component.
Figure 6:
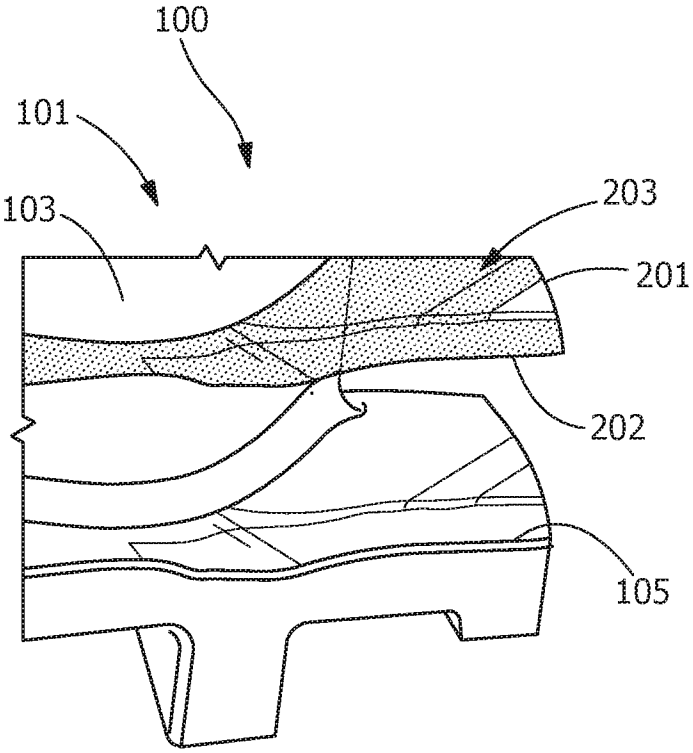
FIG. 6 is an enlarged view of an article positioned over an end wall of a component, according to an embodiment of the disclosure.

In contrast to the article 601 with a flat surface 603 of FIG. 7 that conforms to the first end wall 105 during the securing process, the shape and/or contour of the contoured proximal face 202 provides a closer tolerance between the article 201 and the first end wall 105 (FIG. 6) and/or the second end wall 107 and/or the airfoil portion 103. The closer tolerance provided by the article 201 decreases or eliminates the formation of gaps and/or increases joint quality between the article 201 and the first end wall 105 and/or the second end wall 107 and/or the airfoil portion 103. This increases manufacturing yield of the component 100, increases a life cycle of the component 100, increases cooling effectiveness of the component 100, or a combination thereof.

Additionally, the contoured distal face 203, which is positioned opposite or substantially opposite the contoured proximal face 202 with respect to the article 201, forms an exterior surface over the first end wall 105 and/or the second end wall 107. The exterior surface formed by the contoured distal face 203 may be the same, substantially the same, or different from the first end wall 105 and/or the second end wall 107, and provides any suitable surface characteristic over the first end wall 105 and/or the second end wall 107. For example, the surface characteristic may be the same as the first end wall 105 and/or the second end wall 107 and/or the airfoil portion 103, or may include a modified surface characteristic. Suitable modified surface characteristics include, but are not limited to, hardness, corrosion resistance, temperature resistance, machinability, or a combination thereof.

Figure 8:
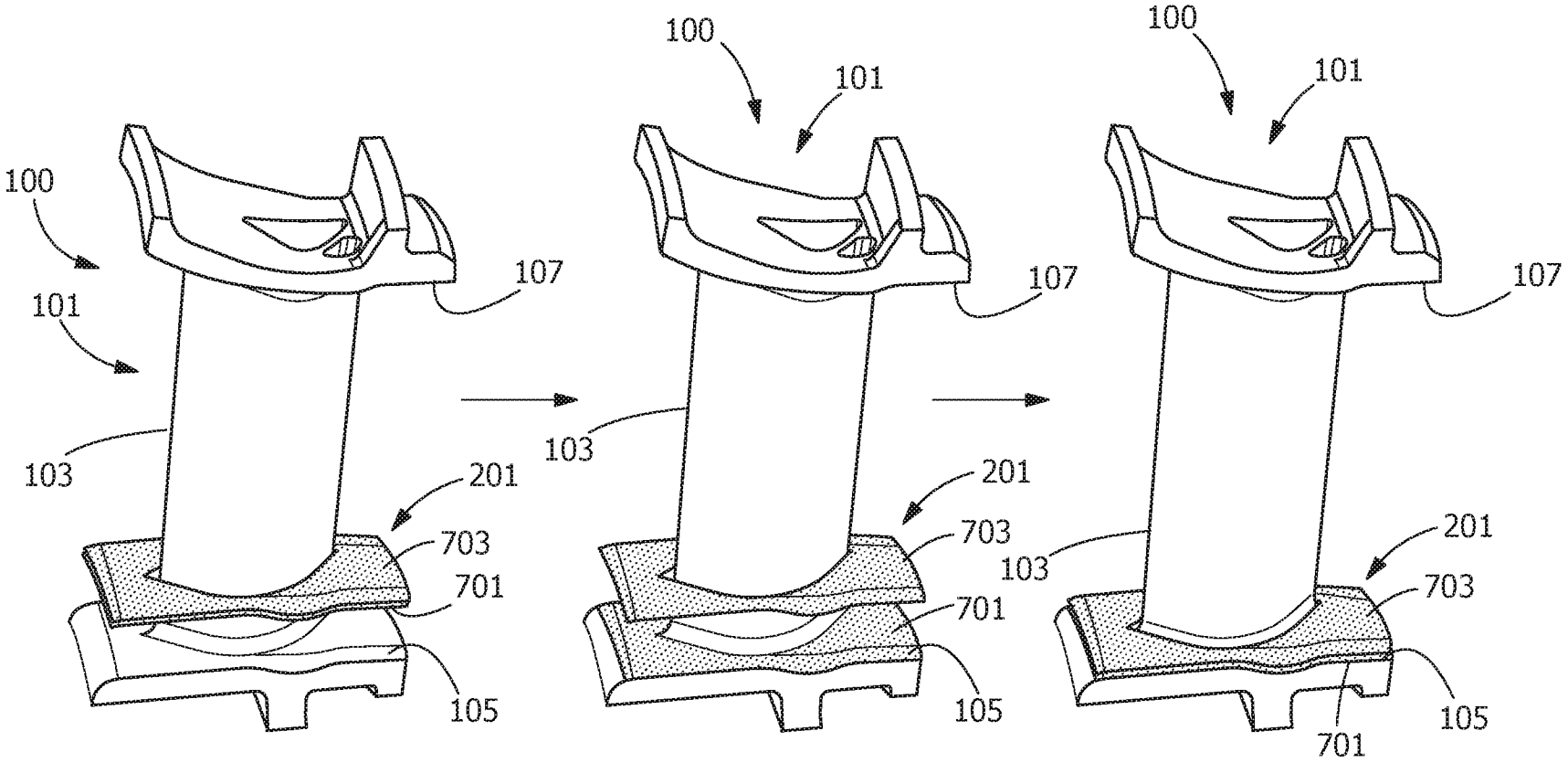
FIG. 8 is a process view of a method of forming a component, according to another embodiment of the disclosure.

In an alternate embodiment, as illustrated in FIG. 8, at least one intermediate member 701 is positioned between the article 201 and the first end wall 105 and/or the second end wall 107 and/or the airfoil portion 103. The intermediate member 701 includes any material or combination of materials suitable for indirectly securing the article 201 to the first end wall 105 and/or the second end wall 107. For example, in one embodiment, the intermediate members 701 includes a paste, slurry, powder, or other material configuration as an intermediate member 701 material for facilitating the securing of the article 201 to the first end wall 105 and/or the second end wall 107 and/or the airfoil portion 103. The intermediate member 701 may be used to prevent separation between multiple pieces when the article 201 pieces are set on the surface of the nozzle. The intermediate member 701 may be applied to enable smooth transitions to other features, if necessary.

In another embodiment, the intermediate member 701 includes a first surface and a second surface that are arranged and disposed to indirectly secure the article 201 to the first end wall 105 and/or the second end wall 107 and/or the airfoil portion 103. In a further embodiment, when the article 201 is indirectly secured to the first end wall 105 and/or the second end wall 107 and/or the airfoil portion 103 through the intermediate member 701, the contoured distal face 203 forms the exterior surface over the first end wall 105 and/or the second end wall 107 and/or the airfoil portion 103.

Prior to securing, the first surface of the intermediate member 701 includes a shape and/or contour that mirrors or substantially mirrors the shape and/or contour of the first end wall 105 and/or the second end wall 107 and/or the airfoil portion 103, and the second surface of the intermediate member 701 includes a shape and/or contour that mirrors or substantially mirrors the shape and/or contour of the contoured proximal face 202 of the article 201. When the first surface of the intermediate member 701 is secured to the first end wall 105 and/or the second end wall 107 and/or the airfoil portion 103, the second surface of the intermediate member 701 provides an intermediate surface over the first end wall 105 and/or the second end wall 107 and/or the airfoil portion 103. The intermediate surface facilitates securing of the contoured proximal face 202 thereto, which, in combination with the contoured proximal face 202, provides closer tolerance between the article 201 and the first end wall 105 and/or the second end wall 107 and/or the airfoil portion 103, as compared to the flat surface 603 shown in FIG. 7.

Any of the alloy compositions described herein may include incidental impurities.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. An article comprising:

a pre-sintered preform having:

a contoured proximal face; and a contoured distal face;

wherein the contoured proximal face is arranged and disposed to mirror a contour of at least one of an end wall and an airfoil outer surface of a component, such that installation of the pre-sintered preform on the at least one of the end wall and the airfoil outer surface results in continuous, direct contact between the contoured proximal face and the contour of the component;

wherein the pre-sintered preform is formed of a mixture of a first powder material and a second powder material, the second powder material being a braze alloy; and wherein the first powder material is the same material as the component.

2. The article of claim 1, wherein a contour of the contoured distal face differs from a contour of the contoured proximal face.

3. The article of claim 1, wherein the contoured distal face is arranged and disposed to provide an exterior surface over the end wall of the component.

4. The article of claim 3, wherein the exterior surface provides a modified surface characteristic, the modified surface characteristic being selected from the group consisting of hardness, corrosion resistance, temperature resistance, machinability, or a combination thereof.

5. The article of claim 1, wherein the component is a hot gas path component of a gas turbine.

6. An assembly comprising:

a hot gas path component comprising:

a first end wall having a first contoured surface;

a second end wall having a second contoured surface facing the first contoured surface; and an airfoil positioned between the first end wall and the second end wall, the airfoil having an airfoil outer surface; and a pre-sintered preform having a proximal face secured to at least one of the first contoured surface, the second contoured surface, and the airfoil outer surface, the pre-sintered preform further having a contoured distal face opposite the contoured proximal face;

wherein a contour of the proximal face mirrors the at least one of the first contoured surface, the second contoured surface, and the airfoil outer surface such that the proximal face is in continuous, direct contact with the at least one of the first contoured surface, the second contoured surface, and the airfoil outer surface;

wherein the pre-sintered preform is formed of a mixture of a first powder material and a second powder material, the second powder material being a braze alloy; and wherein the first powder material is the same material as the hot gas path component.

7. The assembly of claim 6, wherein the hot gas path component is a nozzle of a gas turbine.

8. The assembly of claim 6, wherein a material of the hot gas path component is selected from the group consisting of a metal, a ceramic, an alloy, a superalloy, steel, a stainless steel, a tool steel, nickel, cobalt, chrome, titanium, aluminum, and combinations thereof.

9. The assembly of claim 6, wherein a contour of the contoured distal face differs from the contour of the proximal face.

10. The assembly of claim 6, wherein the contoured distal face is arranged and disposed to provide an exterior surface providing a modified surface characteristic over the first end wall of the hot gas path component, the modified surface characteristic being selected from the group consisting of hardness, corrosion resistance, temperature resistance, machinability, or a combination thereof.

11. The assembly of claim 6, wherein a tolerance between the contour of the proximal face and the at least one of the first contoured surface, the second contoured surface, and the airfoil outer surface eliminates a formation of gaps between the pre-sintered preform and the at least one of the first contoured surface, the second contoured surface, and the airfoil outer surface.

12. A method comprising:

forming an article comprising a pre-sintered preform having a proximal face and a distal face;

contouring the proximal face of the pre-sintered preform to form a contoured proximal face; and securing the contoured proximal face of the pre-sintered preform to one of a first end wall, a second end wall, and an airfoil portion of a component;

wherein, prior to the step of securing, the contoured proximal face mirrors a contour of the one of the first end wall, the second end wall, and the airfoil portion of the component;

wherein the step of securing the contoured proximal face to the contour of the component results in continuous, direct contact between the contoured proximal face and the contour of the component;

wherein the pre-sintered preform is formed of a mixture of a first powder material and a second powder material, the second powder material being a braze alloy; and wherein the first powder material is the same material as the component.

13. The method of claim 12, further comprising contouring the distal face of the pre-sintered preform to form a contoured distal face, the contoured distal face differing from the contoured proximal face.

14. The method of claim 12, wherein the step of contouring the proximal face occurs prior to the step of securing and decreases a tolerance between the contoured proximal face and the contour of the one of the first end wall, the second end wall, and the airfoil portion.

15. The method of claim 12, wherein the step of securing comprises brazing.

16. The method of claim 15 further comprising applying a bond coat and a thermal barrier coating to the component after brazing.

* * * * *